US008168927B2

(12) United States Patent
Kutz

(10) Patent No.: US 8,168,927 B2
(45) Date of Patent: May 1, 2012

(54) APPARATUS, ARRANGEMENT AND METHOD FOR SUPPORTING A HELICAL WIRE COIL HEATING ELEMENT

(75) Inventor: Edward A. Kutz, Franklin, WI (US)

(73) Assignee: Nova Coil, Inc., Franklin, WI (US)

( * ) Notice: Subject to any disclaimer, the term of this patent is extended or adjusted under 35 U.S.C. 154(b) by 1126 days.

(21) Appl. No.: 11/936,407

(22) Filed: Nov. 7, 2007

(65) Prior Publication Data

US 2008/0173636 A1 Jul. 24, 2008

Related U.S. Application Data

(60) Provisional application No. 60/865,286, filed on Nov. 10, 2006.

(51) Int. Cl.
*H05B 3/06* (2006.01)
*F24H 3/02* (2006.01)
*F26B 11/02* (2006.01)

(52) U.S. Cl. ..... 219/521; 392/360; 34/132

(58) Field of Classification Search ..... 219/520, 219/521, 531, 532, 534, 535, 536, 537; 392/349, 392/350, 360; 34/108, 132, 601, 602, 603; 174/137 R, 138 J, 158 R, 167
See application file for complete search history.

(56) References Cited

U.S. PATENT DOCUMENTS 3,036,145 A * 5/1962 Murphy ..... 174/395
3,111,571 A * 11/1963 De Camp ..... 392/350
3,790,751 A * 2/1974 Kuhn ..... 219/525
3,887,790 A 6/1975 Ferguson
4,341,946 A 7/1982 Ohnmacht et al.
4,350,872 A 9/1982 Meywald et al.
4,565,921 A 1/1986 Piazzola
4,994,654 A 2/1991 St. Louis
5,146,536 A 9/1992 Westover
5,935,471 A 8/1999 St. Louis
6,002,116 A 12/1999 St. Louis
6,259,070 B1 7/2001 Audet
6,285,013 B1 9/2001 Holmes
6,376,814 B2 4/2002 Holmes
6,593,554 B2 7/2003 Danko et al.
6,807,220 B1 10/2004 Peck

* cited by examiner

*Primary Examiner* — Sang Paik
(74) *Attorney, Agent, or Firm* — Andrus, Sceales, Starke & Sawall, LLP

(57) ABSTRACT

An apparatus, arrangement and method for supporting a helical wire coil heating element is provided. The apparatus includes a generally circular support frame having an open center portion and a plurality of supporting arms extending radially inward into the open center portion. Insulating standoffs are supported on the supporting arms such that the standoffs extend into the open center portion of the frame. A helical wire coil heating element is attached to each end of the standoff. An arrangement for supporting a helical wire coil heating element includes a substantially closed elongated tubular wrapper having an open interior. One or more generally circular support frames are arranged in the open interior of the wrapper and support insulating standoffs. A method for assembling an arrangement for a supporting a helical wire coil heating element is further provided.

12 Claims, 15 Drawing Sheets

APPARATUS, ARRANGEMENT AND METHOD FOR SUPPORTING A HELICAL WIRE COIL HEATING ELEMENT

CROSS-REFERENCE TO RELATED APPLICATION

This application claims priority from U.S. Provisional Patent Application No. 60/865,286, filed Nov. 10, 2006.

BACKGROUND AND SUMMARY

The present invention relates to electric resistance heating elements.

Electric heating elements utilizing helical wire heating coils are well known in the art. A helical wire heating coil is typically mounted on a support structure and strung between a number of ceramic insulating standoffs that provide direct support for the heating coil and isolate the heating coil from the supporting structure, which is generally some type of metal framework.

The present invention arose from initiatives to improve upon apparatus, arrangements and methods for supporting a helical wire coil heating element.

In one example, an apparatus for supporting a helical wire coil heating element is provided. The apparatus includes a generally circular support frame having an open center portion and a plurality of supporting arms extending radially inward into the open center portion. Insulating standoffs are supported on the supporting arms such that the standoffs extend into the open center portion of the frame. A helical wire coil heating element is attached to each end of the standoff.

In another example, an arrangement for supporting a helical wire coil heating element is provided that includes a substantially closed elongated tubular wrapper having an open interior. One or more generally circular support frames are arranged in the open interior of the wrapper and support insulating standoffs.

A method is also described for assembling an arrangement for supporting a helical wire coil heating element.

BRIEF DESCRIPTION OF THE DRAWINGS

The drawings illustrate preferred embodiments and the best mode presently contemplated of carrying out the invention. In the drawings.

DETAILED DESCRIPTION OF THE DRAWINGS

Figure 1:
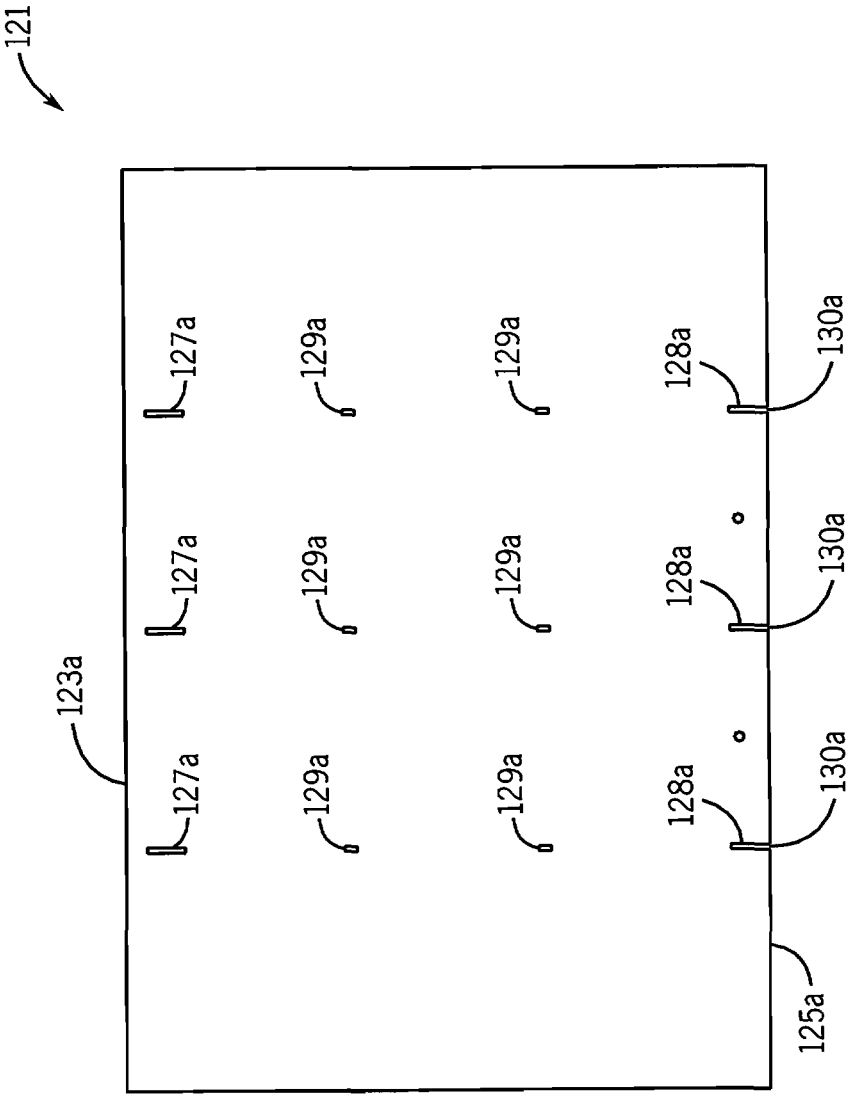
FIG. 1 is a plan view of a flat piece of sheet metal that forms one half of a tubular wrapper.

FIG. 1 shows a flat sheet 121 that forms half of a tubular wrapper or conduit for conveying hot air, which will be discussed later in this description. The wrapper half 121 is formed from metal, such as steel. The wrapper half 121 includes opposite elongated ends 123*a*, 125*a*. A series of slots 127*a* are formed along the end 123*a*. A series of slits 128*a* having an open end 130*a* are formed along the end 125*a*, which is opposite the end 123*a*. Another series of slots 129*a* are formed the middle portion of the sheet.

Figure 2:
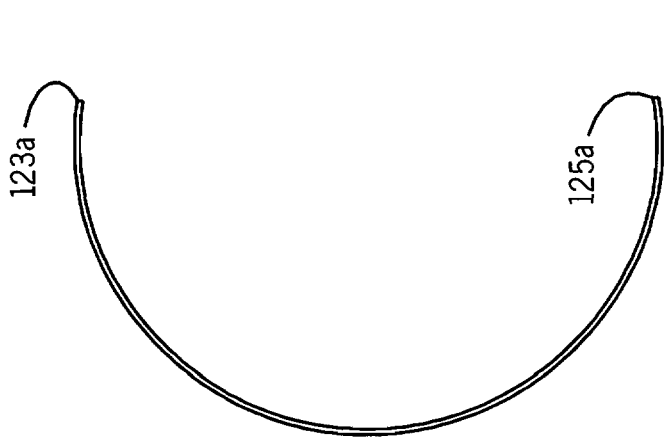
FIG. 2. is an end view of the flat piece of sheet metal shown in FIG. 1, bent into a curved shape.

FIG. 2 shows an end view of the sheet 121 bent into a curved shape to form half of a tubular wrapper.

Figure 3:
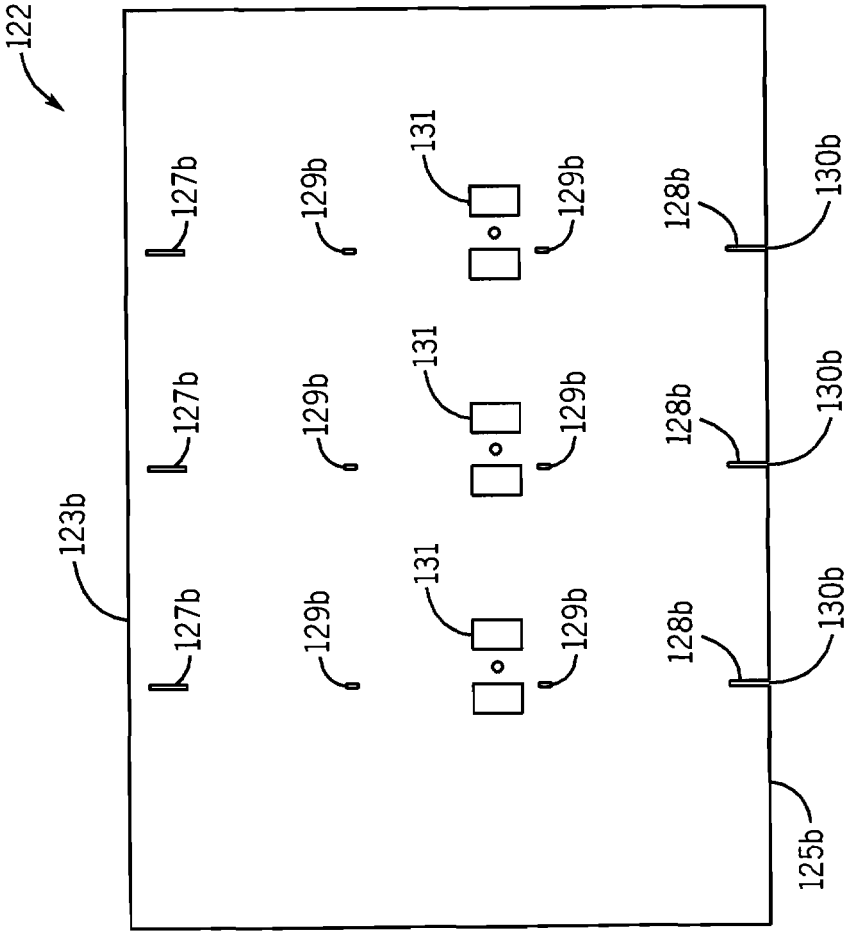
FIG. 3 is a plan view of a flat piece of sheet metal that forms a second half of the tubular wrapper.

FIG. 3 shows a flat sheet 122 that forms half of a tubular wrapper or conduit for conveying hot air, which will be discussed later in this description. The wrapper half 122 is formed from metal, such as steel. The wrapper half 122 includes opposite elongated ends 123*b*, 125*b*. A series of slots 127*b* are formed along the end 123*b*. A series of slits 128*b* having an open end 130*b* are formed along the end 125*b*, opposite the end 123*b*. Another series of slots 129*a* are formed the middle portion of the sheet.

Figure 4:
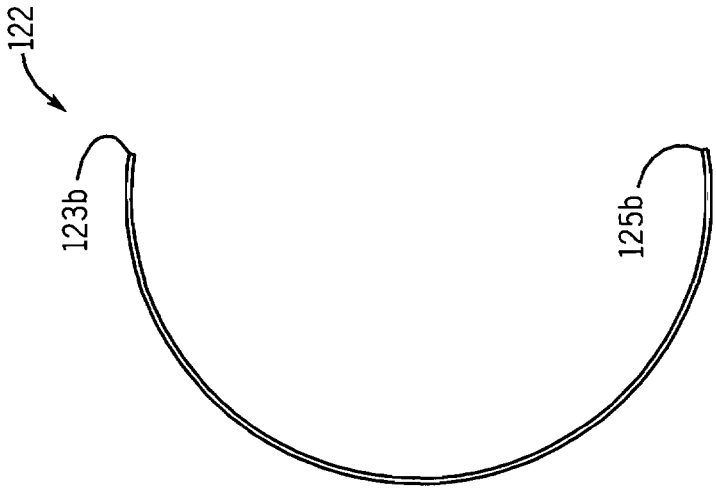
FIG. 4 is an end view of the flat piece of sheet metal shown in FIG. 3, bent into a curved shape.

FIG. 4 shows an end view of the sheet 121 bent into a curved shape to form half of the tubular wrapper.

Figure 5:
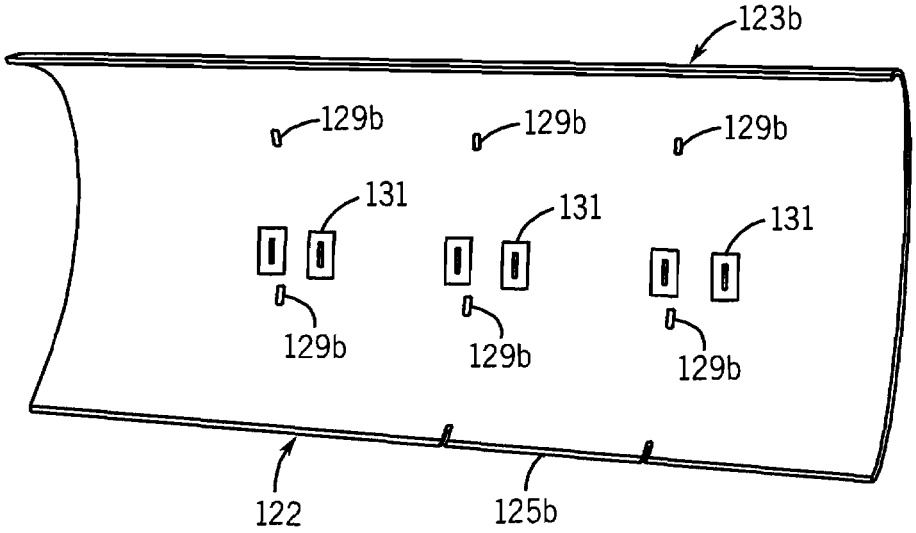
FIG. 5 shows the inside of the curved wrapper half of FIG. 4, having terminal blocks attached thereto.
Figure 6:
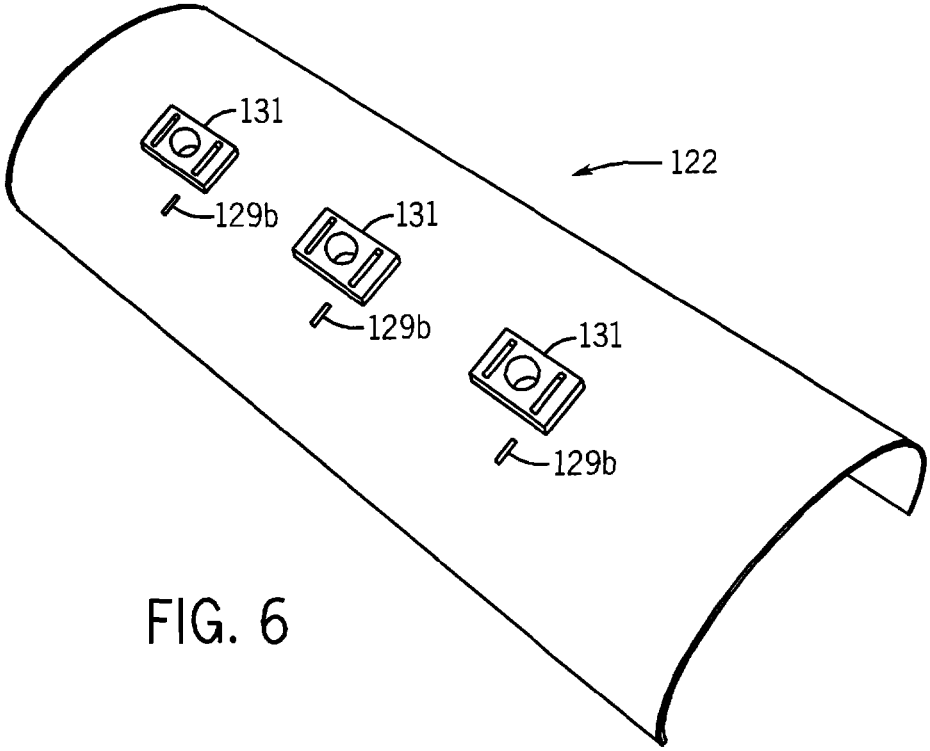
FIG. 6 shows the outside of the wrapper half of FIG. 5.

As shown in FIGS. 5 and 6, a plurality of terminal blocks 131 are installed in the middle portion of the wrapper half 122.

Figure 8:
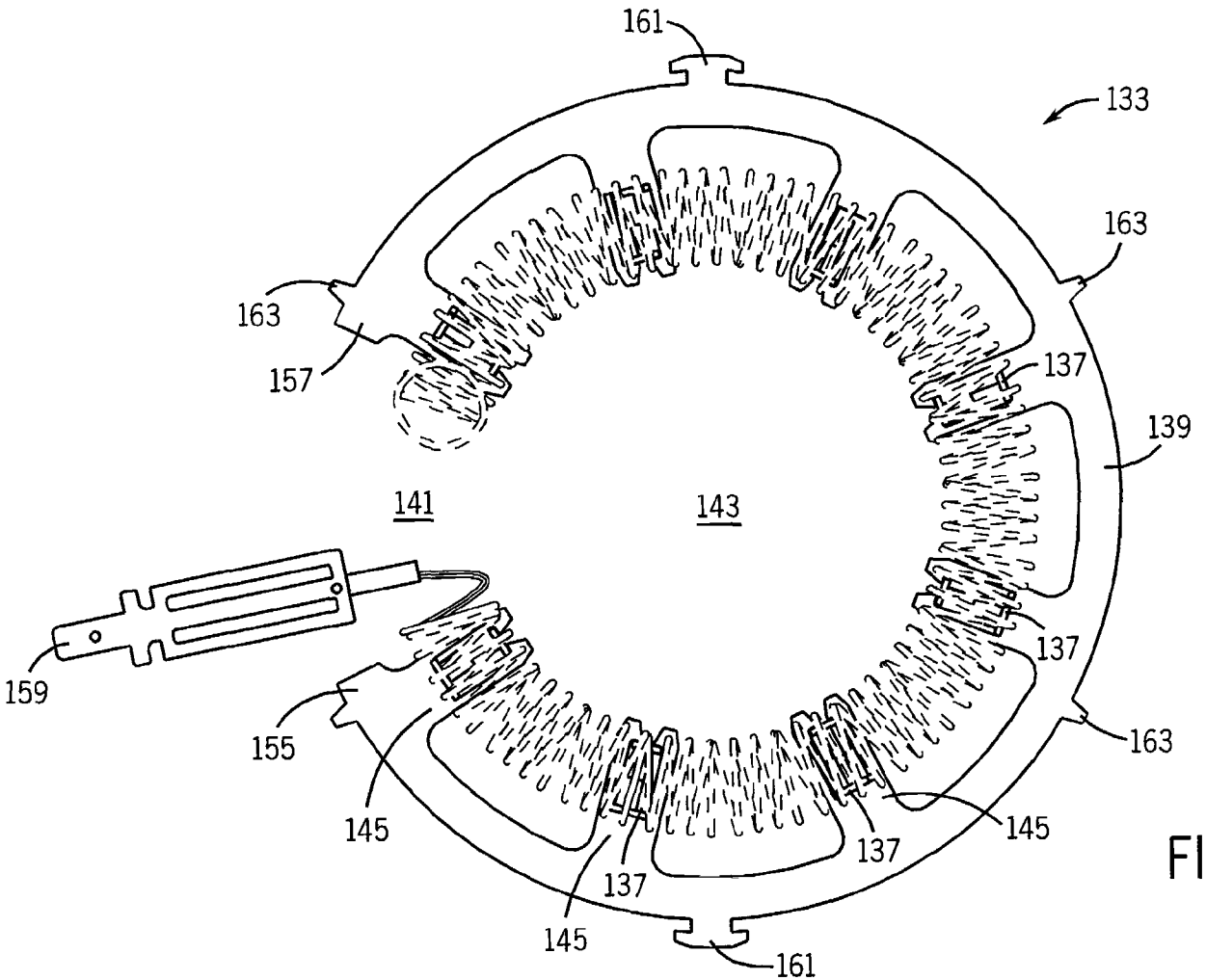
FIG. 8 shows a support frame assembly, including the support frame of FIG. 5 supporting insulating standoffs and a helical wire coil heating element.
Figure 9:
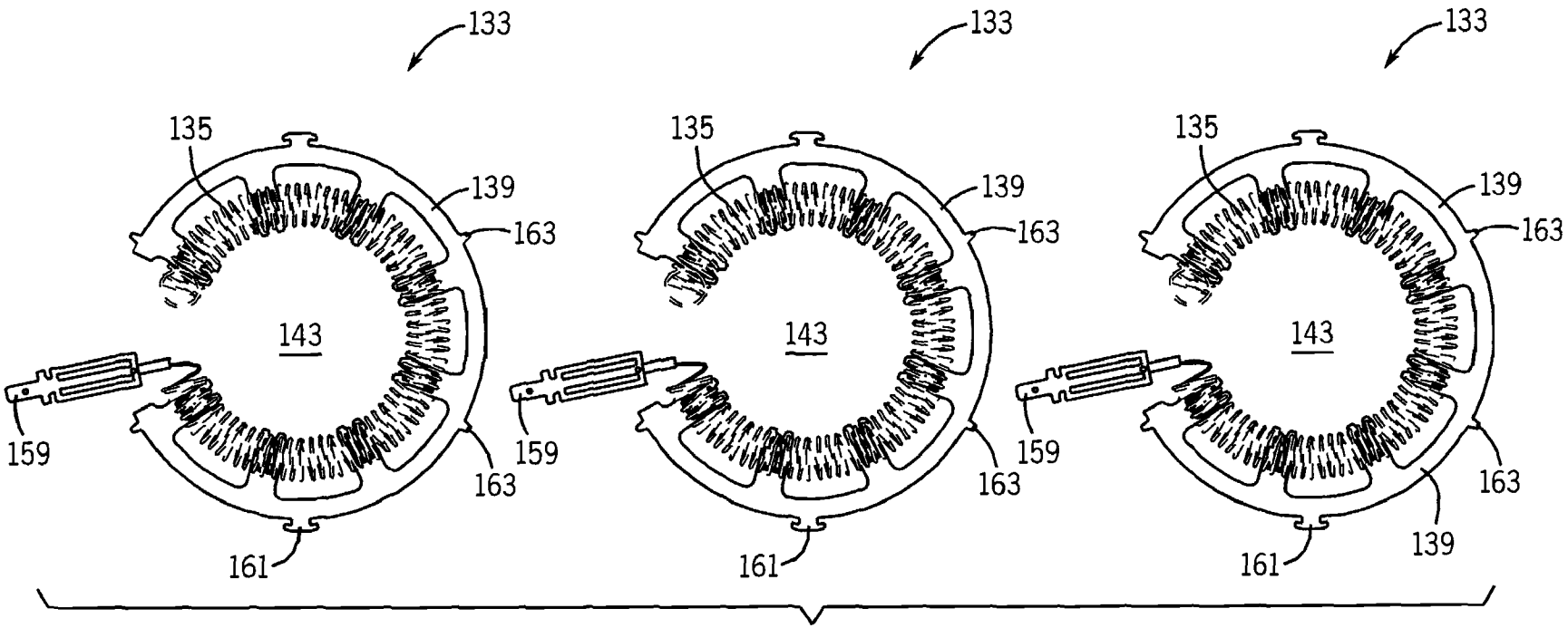
FIG. 9 shows three support frame assemblies like the one shown in FIG. 8.

As shown in FIGS. 8 and 9, a heating element support frame assembly 133 includes a conventional helical wire resistance heating coil 135 mounted between a plurality of insulating standoffs 137. The insulating standoffs 137 are in turn held by a support frame 139.

Figure 7:
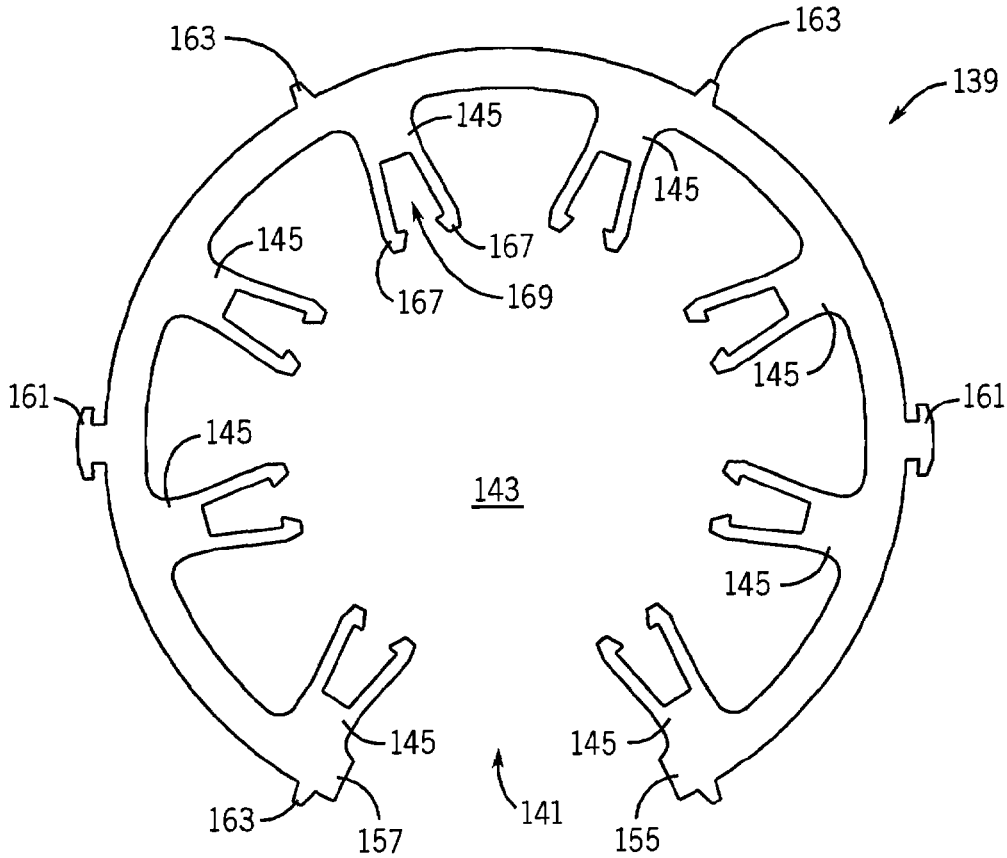
FIG. 7 is a plan view of a generally circular support frame.

As shown in FIG. 7, the support frame 139 is a stamped metallic element formed of sufficient strength to support the standoffs 137. The support frame 139 generally includes a circular rail extending in a circular shape between a first end 155 and a second end 157. The first end 155 and second end 157 are separated to form a gap 141. A plurality of support arms 145 extend radially inward into an open center portion 143 formed by the circular rail. The outer circumference of the support frame 139 includes a plurality of tabs for connection to the inner surface of the wrappers 121, 122, as will be discussed later in this description. More specifically, a pair of opposed T-shaped tabs 161 are provided on opposite sides of the circular support frame 139 and four generally straight tabs 163 are provided on the support frame 139 intermediate the T-shaped tabs 161. It is recognized that the number and shape of tabs may be varied from that shown in the application.

As stated earlier, the support frame 139 includes a plurality of support arms 145 extending inward into the open center portion 143 from the support frame 139 between the first end 155 and second end 157. Each of the support arms 145 supports one of the insulating standoffs 137 such that the insulating standoff 137 is able to hold the heating coil 135 away from the metallic support frame 139.

Each of the support arms 145 includes a pair of tines 167. The tines 167 are spaced from each other and define an open slot 169 therebetween. The open slot 169 is defined by the inside edge of each tine 167 and a back edge formed on the support arm 145. A similar arrangement for support arms is discussed in commonly owned U.S. Pat. Nos. 6,285,013 and 6,376,814. The pair of tines 167 on each arm 145 is arranged to receive attachment slots on the insulating standoffs 137, as described further below regarding drawings 19-21.

The insulating standoffs 137 are of the type described in U.S. Pat. Nos. 6,285,013 and 6,376,814. However, it is recognized that different standoffs could be utilized within the scope of the present invention.

Figure 19:
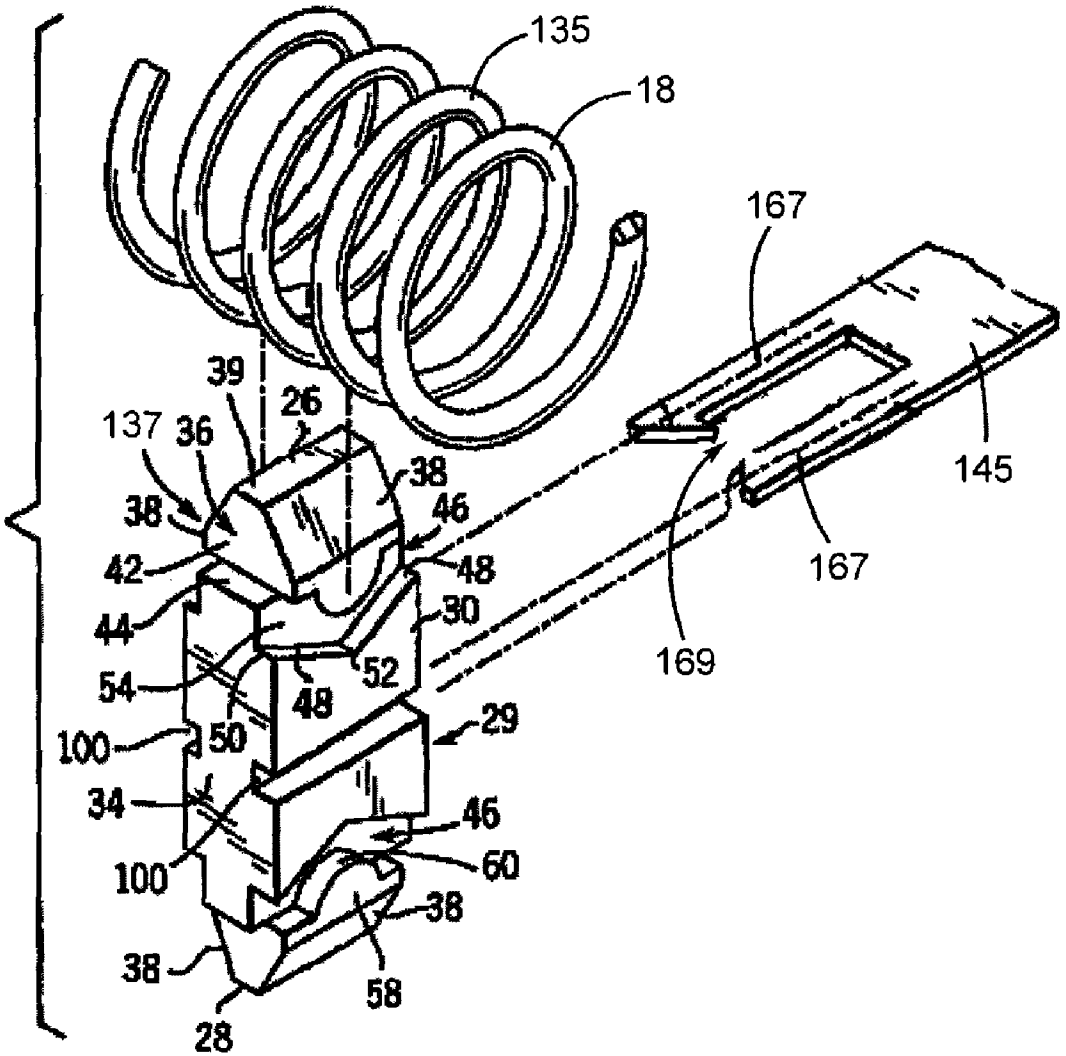
FIG. 19 is an exploded perspective view of one of the insulating standoffs and an arm of the support frame showing the interaction between the standoff and the helical wire heating coil supported thereon.
Figure 21:
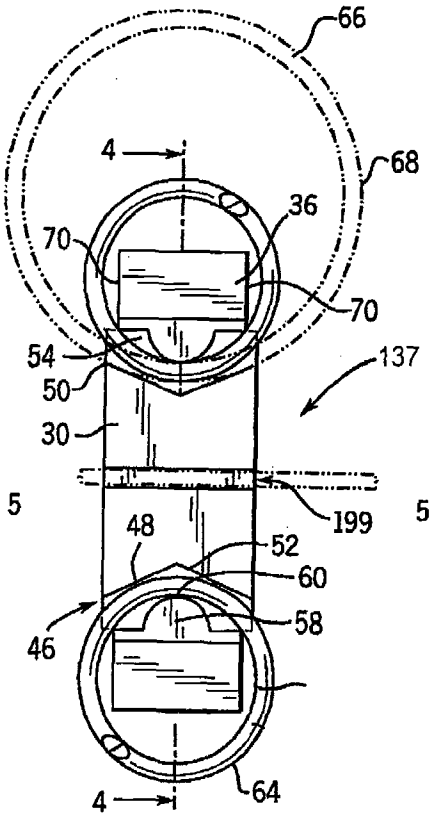
FIG. 21 is a view showing the interaction between the helical wire heating coil and the insulating standoff.
Figure 20:
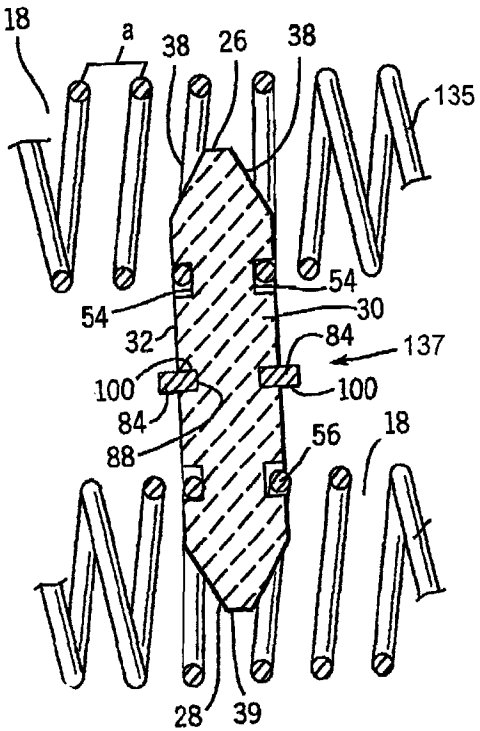
FIG. 20 is a sectional view showing the interaction between the insulating standoff and the helical wire heating coil.

Referring to FIGS. 19-21, each of the insulating standoffs 137 are generally rectangular and are used to position a section 18 of the coil 135 away from the support frame. In the preferred embodiment of the invention, the insulating standoffs 137 are formed from ceramic such that they prevent current from flowing into the support frame from the coil.

An insulating standoff 137 extends lengthwise along a longitudinal axis between a first end 26 and a second end 28. The insulating standoff 137 has a body portion 29 having a generally planar front face 30 and a generally planar back face 32. The front face 30 and the back face 32 are generally parallel and separated by a pair of edge surfaces 34 that define the overall thickness of the body portion 29 of the insulating standoff 137.

Both the first end 26 and the second end 28 of each insulating standoff 137 includes a wedge portion 36. Each of the wedge portions 36 includes a pair of ramp surfaces 38 which are outwardly divergent from the first end 26 and the second end 28 to the respective front face 30 and back face 32. Both the first end 26 and the second end 28 are defined by a generally flat surface 39 that defines the point of the respective wedge section 36. The width of each of the wedge portions 36 is defined by a pair of side surfaces 42 that are each spaced slightly inward from the edge surface 34, such that a shoulder 44 is formed between the side surface 42 and the edge surface 34.

Each of the insulating standoffs 137 includes four V-shaped coil grooves 46 that are used to retain the individual convolutions of the heating coil 135. As can be understood in the Figures, a pair of coil grooves 46 are formed in the front face 30 of the insulating standoff 137, and a pair of coil grooves 46 are formed in the back face 32 of the insulating standoff 137. Additionally, the coil grooves 46 are positioned such that one of the pair of the coil grooves 46 formed in the front face 30 is positioned directly adjacent the wedge portion 36 formed on the first end 26 of the standoff 137 and the second of the pair of coil grooves 46 formed in the front face 30 is positioned directly adjacent the wedge portion 36 formed on the second end 28 of the standoff 137. The coil grooves 46 formed in the back face 32 are located in the same positions as the coil grooves 46 in the front face 30, such that the standoff 137 has the same appearance when viewed from the front or back, or with the first end 26 up or the second end 28 up. This feature reduces the amount of labor required when assembling the heating element, since it is immaterial how the standoff 137 is oriented when mounted to the support frame 139. In this manner, each of the standoffs 137 is capable of supporting a first coil section 18 near its first end 26 and a second coil section 18 near its second end 28, as is shown in FIG. 20.

Each of the coil grooves 46 has a depth extending inwardly from either the front face 30 or the back face 32 of the insulating standoff 137. The coil grooves 46 are each defined by a pair of contact surfaces 48. The contact surfaces 48 are outwardly divergent from the centerline of the standoff 137 to the edge surfaces 34 of the standoff 137. Each of the contact surfaces 48 defines an abutment shoulder 50 at the intersection between the contact surface 48 and the edge surface 34. As can be seen in FIG. 19, the abutment shoulder 50 is spaced slightly from the shoulder 44 defined between the side surface 42 of the wedge portion 36 and the edge surface 34 of the standoff 137. In the preferred embodiment of the invention, the angle between the pair of contact surfaces 44, which defines the trough 52 of the V-shaped coil groove 46, is approximately 135 degrees.

Each of the coil grooves 46 includes a generally flat, recessed surface 54 which is spaced inwardly from either the front face 30 or the back face 32 of the standoff 137. In the preferred embodiment of the invention, the recessed surface 54 is spaced inwardly by the height of the abutment shoulder 50 such that when the heating coil 135 is retained by the standoff 137, the depth of the coil groove 46 is approximately equal to the diameter of the wire 56 forming the heating coil 135. In this manner, the outermost portion of the wire 56 is approximately flush with the front face 30 and the back face 32 of the standoff 137 when the coil section 18 is supported by the standoff 137.

As can be seen in FIG. 20, the overall thickness of the insulating standoff 137 between surfaces 54 of the coil grooves 46 on the front face 30 and the back face 32 is greater than the distance "a" between individual convolutions of the heating coil 135. In this manner, the inherent resiliency of the heating coil 135 along the longitudinal coil axis extending lengthwise through any one of the coil sections 18 forces a pair of convolutions of the respective coil section 18 into the pair of the coil grooves 46 formed in the standoff 137, as will be discussed in greater detail below.

A retainer tab 58 is formed on each wedge portion 36 as shown in FIGS. 19 and 21. The retainer tab 58 is a generally semi-circular projection extending from the wedge portion 36 into the V-shaped coil groove 46. The retainer tab 58 generally extends into the coil groove 46 such that the portion of the retainer tab 58 extending furthest from either the first end 26 or the second end 28 of the standoff 14 is generally aligned with the trough 52 of the coil groove 46, as can be seen in FIG. 21. In the preferred embodiment of the invention, the outer edge surface 60 of the retainer tab 58 is spaced from the contact surfaces 48 defining the coil groove 46 by a distance sufficient to allow the wire 56 defining the heating coil 12 to be positioned between the retainer tab 58 and the contact surfaces 48 of the coil groove 46, as is shown in FIG. 21.

As can be seen in FIG. 20, the standoff 137 can securely hold heating coils 135 having a variety of diameters. Shown in FIG. 21 is a first size heating coil 135. The first size heating coil is a ½ inch diameter heating coil. The ½ inch heating coil is retained by three points of contact with the insulating standoff 137. The first point of contact is between the inner edge 62 of the heating coil and the outer edge 60 of the retainer tab 58. Since the coil groove 46 includes the pair of angled contact surfaces 48, the distance between the semi-circular outer edge 60 of the retainer tab 58 and the contact surfaces 48 varies when measured along the radius of the heating coil 12. Thus, the outside edge 64 of the heating coil 12 is pressed into contact with the pair of contact surfaces 48 defining the coil groove 46 at two locations. In this manner, the individual convolution of the heating coil 12 is slightly deformed such that the inherent resiliency of the heating coil 12 holds the heating coil 12 within the coil groove 46 at three separate contact points.

In addition to the ½ inch diameter heating coil 12, the insulating standoff 137 can also support larger heating coils, such as a 1 inch diameter heating coil 66. When the 1 inch diameter heating coil 66 is supported by the standoff 137, the outside edge 68 of the heating coil 66 is pressed into contact with the pair of abutment shoulders 50. Again, the inherent resiliency of the individual convolution of the heating coil 66 causes the heating coil 66 to contact the standoff 137 at three separate contact points such that the heating coil 66 is securely retained within the coil groove 46 formed in the standoff 137.

As can be seen in FIG. 21, the overall width of the wedge portion 36 between the side surfaces 42 is less than the overall width of the standoff body 29 between the edge surfaces 34. In this manner, the standoff 137 is able to securely retain heating coils having a small diameter. As can be understood in FIG. 21, because of the difference in width between the wedge portion 36 and the body portion 29 of the standoff 137, the inside edge 62 of the heating coil 135 does not contact the edges 70 of the wedge portion 36 when the heating coil 135 is supported by the standoff 137. If the wedge portion 36 had the same width as the body portion 29 of the standoff 137, the heating coil 135 would contact the edges 70 of the wedge portion 36 and prevent the standoff 137 from supporting the heating coil 135, thereby restricting the number of coil sizes the standoff 137 could be used with.

Likewise, the contact surfaces 48 of each coil groove 46 extend outward past the edges 70 of the wedge portion 36 such that the standoff 137 can be used with heating coils having a larger diameter. If the coil groove 46 was only as wide as the wedge portion 36, the heating coil 66 shown in phantom would not fit into the coil groove 46 without causing increased deformation to the individual convolution retained by the coil groove 46. Thus, by having a wedge portion 36 which is somewhat narrower than the body portion 29 of the insulating standoff 137, the insulating standoff 137 can be used with a wider variety of heating coil sizes.

Referring now to FIG. 20, the individual coil section 18 of the heating coil 135 is retained by the insulating standoff 137 as follows. Initially, the first end 26 of the insulating standoff 137, specifically the flat surface 39, is positioned between a pair of the individual convolutions of the coil section 18, such that the coil axis is perpendicular to the longitudinal axis of the standoff 137. With the standoff 137 positioned as such, the coil section 18 and the standoff 137 are pressed into contact with each other. As the contact force is continuously applied, the individual convolutions of the heating coil 135 travel down the angled ramp surfaces 38 such that the individual convolutions of the coil section 18 are separated. When the individual convolutions are separated by the distance equal to the width of the standoff 137, the standoff 137 is further pressed upward into the coil section 18 until the individual convolutions enter the coil grooves 46 between the retainer tab 58 and the contact surfaces 48.

When the insulating standoff 137 has been pushed far enough into the coil section 18, the inherent resiliency of the heating coil 135 in the direction of the coil axis forces the individual convolutions into each of the coil grooves 46 formed on the front face 30 and the back face 32, as is clearly shown in FIG. 20. Once the individual convolutions of the coil section 18 are within the coil grooves 46, the standoff 137 holds the coil section 18 in place. The inherent compressive force of the helical heating coil 135 prevents the coil portion 18 from becoming dislodged in the direction of the coil axis, while the three points of contact between the heating coil 135 and the retainer tab 58 and contact surfaces 48 prevent the coil section 18 from moving laterally with respect to the longitudinal axis of the standoff 137. In this manner, the standoff 137 securely holds the coil section 18 in place with respect to the standoff 137. The same steps detailed above are performed for the coil section 18 attached to the second end 28 of the standoff 137. Likewise, the corresponding steps are followed for each of the plurality of standoffs 137 shown in FIG. 8, such that the heating coil 135 can be securely supported by the plurality of standoffs 137 as shown.

As can also be seen in FIGS. 19-21 each of the insulating standoffs 137 includes a pair of attachment slots 100. One of the attachment slots 100 is formed in the front face 30 and one of the attachment slots 100 is formed in the back face 32. The attachment slots 100 extend across the entire front face 30 and back face 32, respectively, at approximately the midpoint of the standoff 137 between the first end 26 and the second end 28. As can be seen in FIG. 20, the attachment slots 100 extend into the standoff 137 such that the thickness of the standoff 137 between the innermost surface of the attachment slots 100 is approximately the same as the distance between the inside edges 88 of the tines 84. As can be understood in FIG. 20, the width of the standoff 137 between the front face 30 and the back face 32 is greater than the width of the open slot 86 but less than the distance between the outer edges 94 of the tines 84. In this manner, the pair of tines 84 on each arm 82 can support the insulating standoff 137 when the standoff 137 is positioned within the open slot 86.

Referring to FIGS. 10-13, an exemplary arrangement for supporting a helical wire coil heating element is shown. A plurality of support assemblies 133 according to the arrangement discussed above are attached in series to the inside surface of the curved wrapper 122 shown in FIG. 4. Each of the support assemblies 133 includes the support frame 139, standoffs 137 and helical wire coil 135. The terminal block insulates the coil assembly from the wrapper metal via the termination 159. The straight tabs 163 extending from the circumference of the support frame 139 engage with and pass through the middle portion slots 129*b* on the inside surface of the wrapper half 122.

Figure 11:
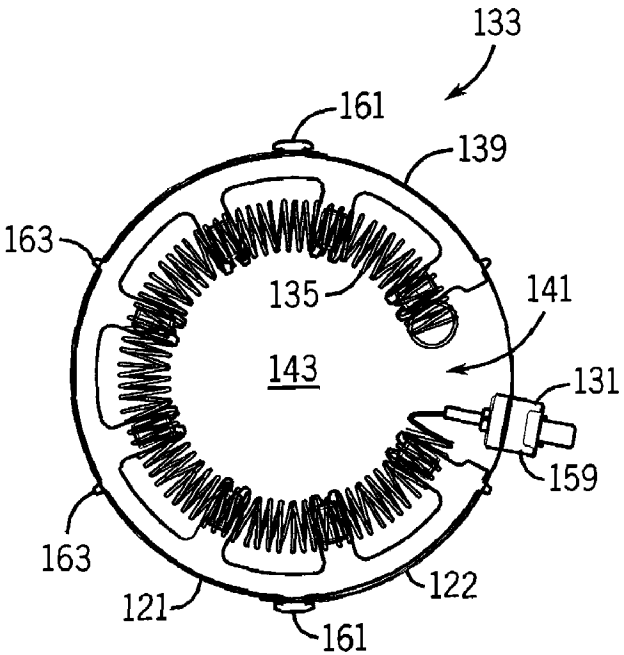
FIG. 11 is an end view of the support frame assemblies and wrapper of FIG. 10.
Figure 17:
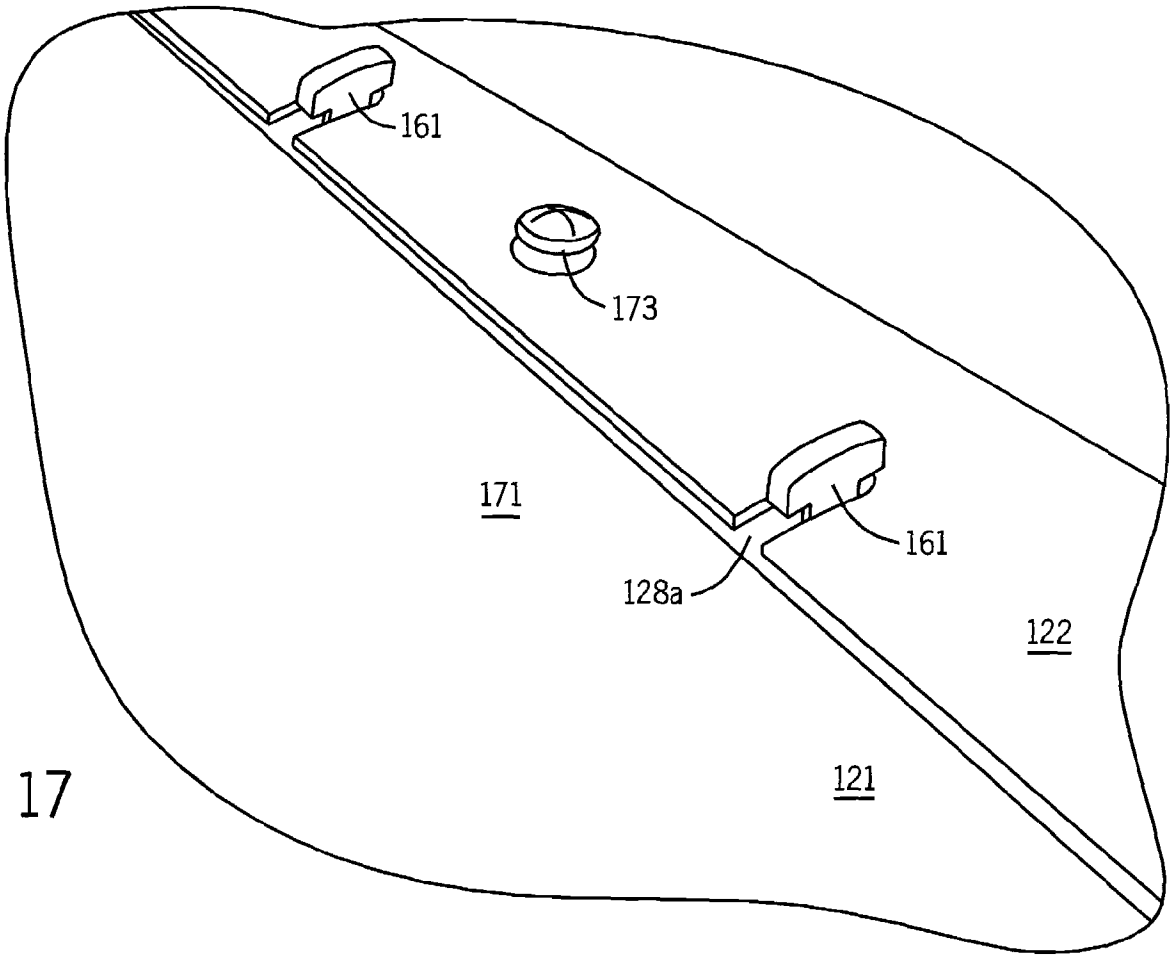
FIG. 17 shows the overlapping end portions of the wrapper halves of FIGS. 2 and 4.
Figure 18:
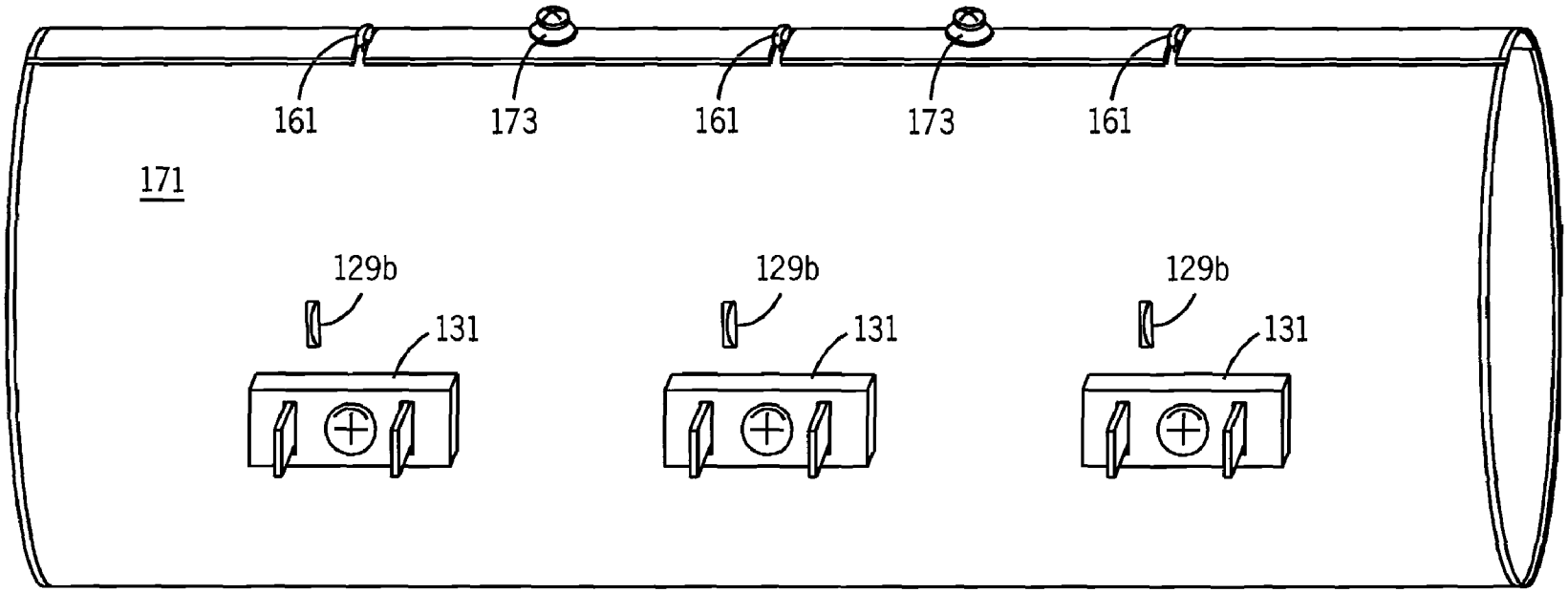
FIG. 18 shows the wrapper halves of FIGS. 2 and 4 connected to form a wrapper.

Referring now to FIGS. 11, 17 and 18, the wrappers 121, 122 are integrally attached to each other to form a conduit or tubular wrapper 171 through which air that is to be heated can pass across the helical wire coil heating elements 135. More specifically, the end portion slots 127*a*, 127*b* on the respective ends 123*a*, 123*b* of the wrappers halves 121, 122 are overlapped and the T-shaped tabs 161 on the outer circumference of the respective aligned support frames 139 are fed through the slots 127*a*, 127*b* to retain the ends 123*a*, 123*b* together. The end portion slits 128*a*, 128*b* on the respective ends 125*a*, 125*b* of the wrapper halves 121, 122 are then overlapped and aligned using the T-shaped tabs 161 on the opposite side of the outer circumference of the respective aligned support frames 139. When connected, the two wrapper halves 121, 122 form a tubular wrapper 171, as shown in FIG. 18. To further secure the connection between the two wrapper halves 121, 122, connection, screws 173 can be installed along the overlapped end portions 123*a*, 123*b*, 125*a*, 125*c*.

Figure 10:
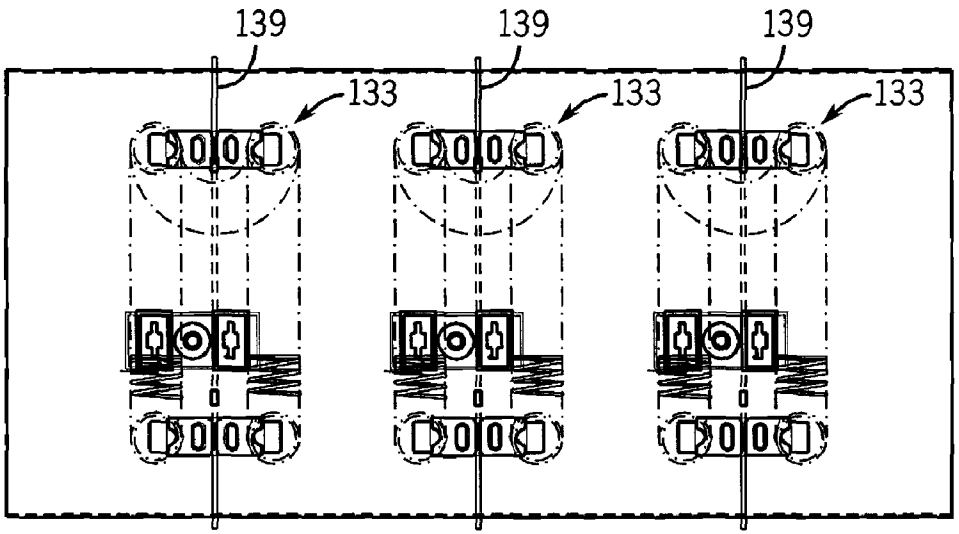
FIG. 10 is a sectional view showing the three support frame assemblies of FIG. 9 attached to the interior of a tubular wrapper.
Figure 12:
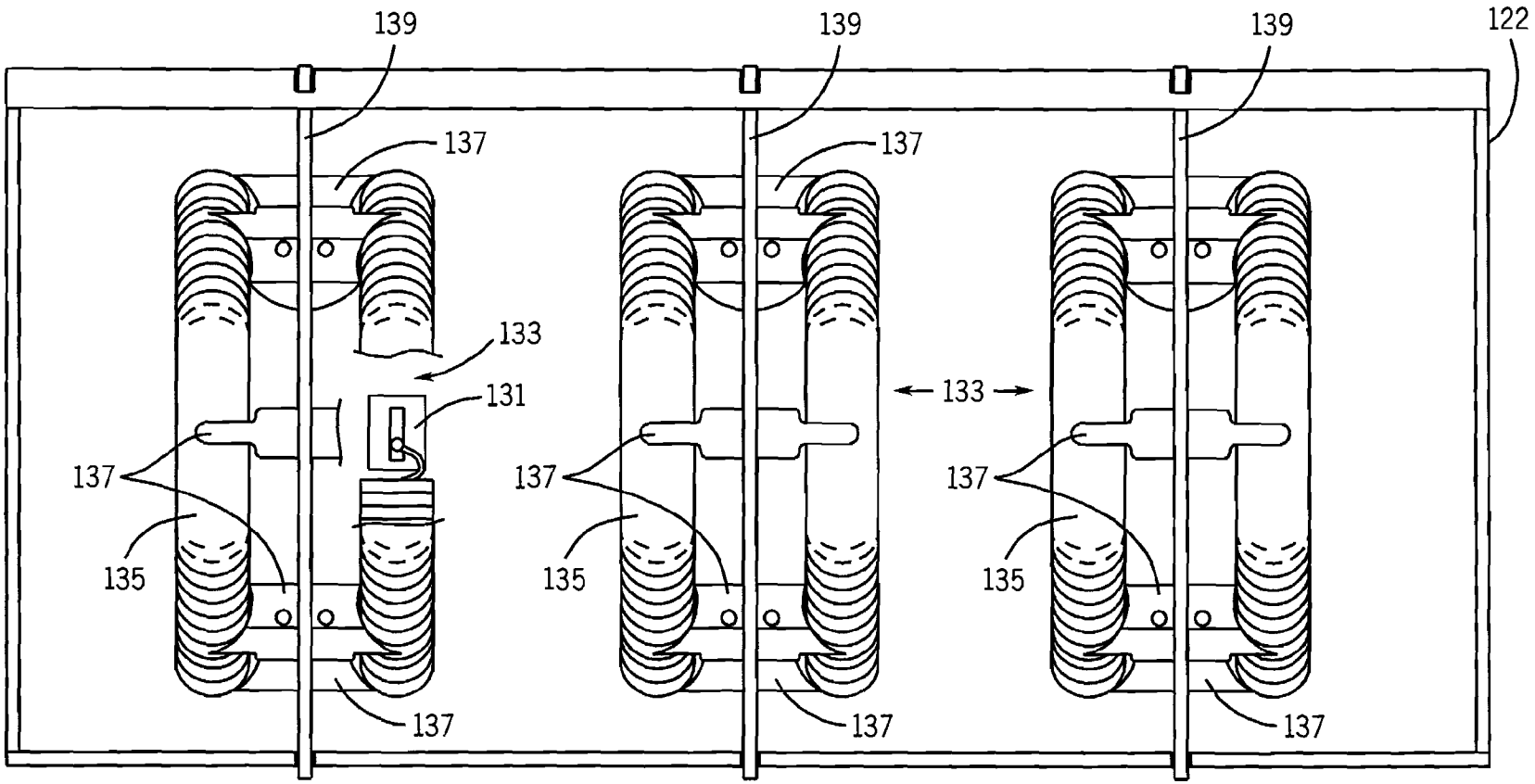
FIG. 12 shows a wrapper half like the one in FIG. 4, having three support frames assemblies attached thereto.
Figure 13:
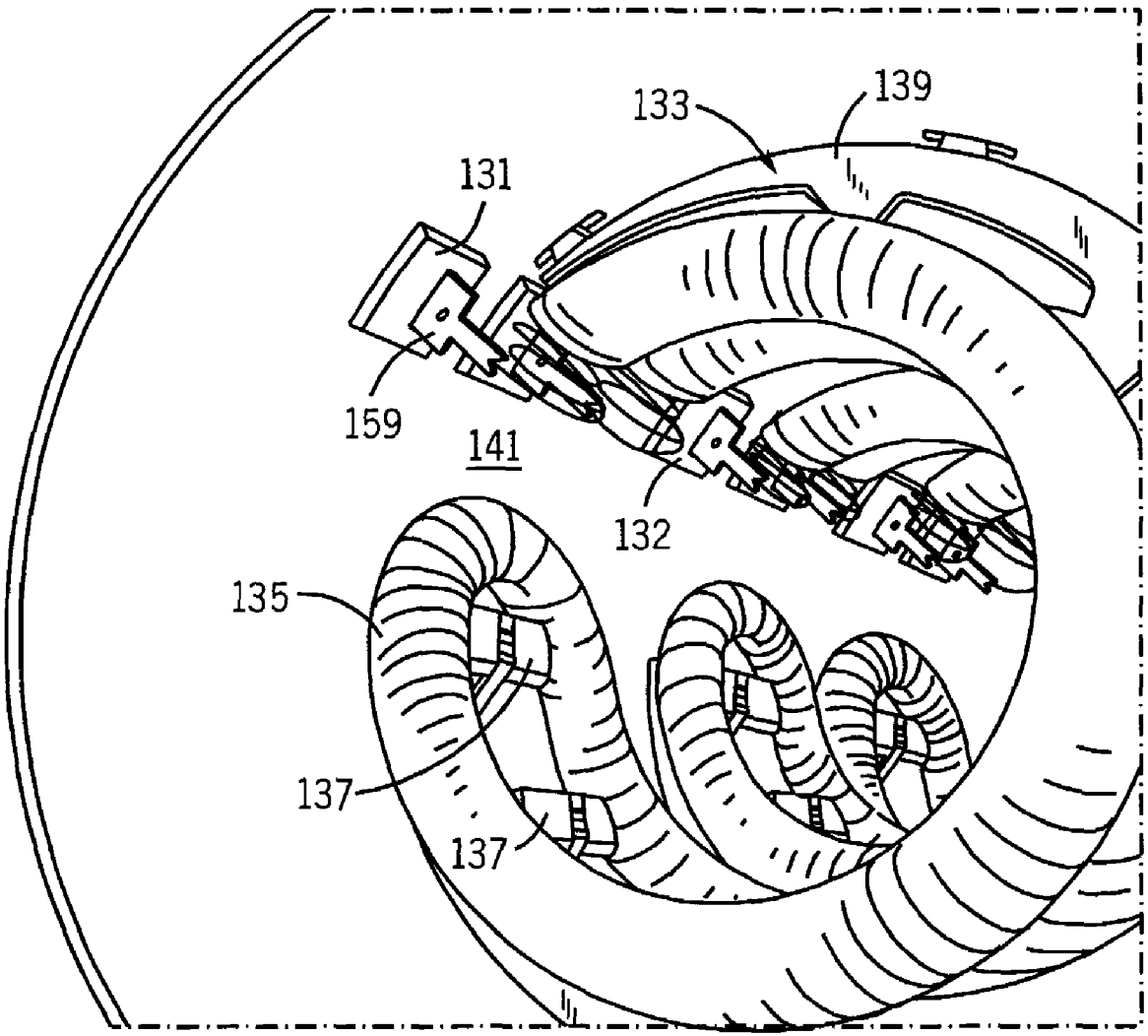
FIG. 13 shows the wrapper half and support frame assemblies of FIG. 12.

In the embodiment of FIGS. 10 and 11, the plurality of support assemblies 133 are attached to the interior of the wrapper 171 in series to provide a compact and easy to use heating element. Advantageously the heat provided by each respective heating element could be varied, which would allow for a choice of lighter and/or heavier gauge wire. For example, the current applied to the respective coils 135 on each support assembly 133 could be varied to achieve a different range of heating. Alternately, or in addition, current could be applied to each respective coil 135 intermittently.

Figure 15:
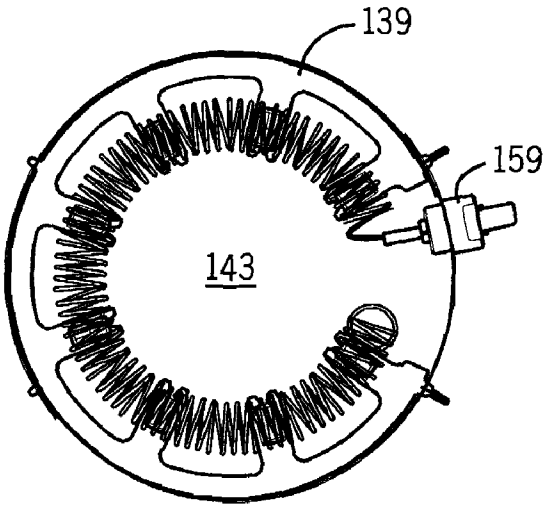
FIG. 15 is an end view of the support frames, wire coil heating element, and wrapper of FIG. 14.
Figure 14:
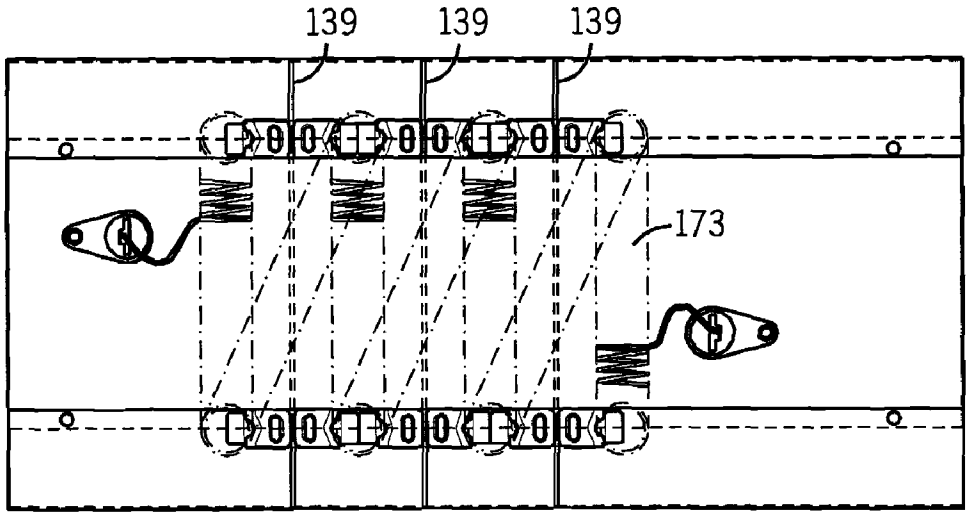
FIG. 14 is a sectional view showing the three support frames attached to a wrapper and a helical wire coil heating element extending between the three support frames.
Figure 16:
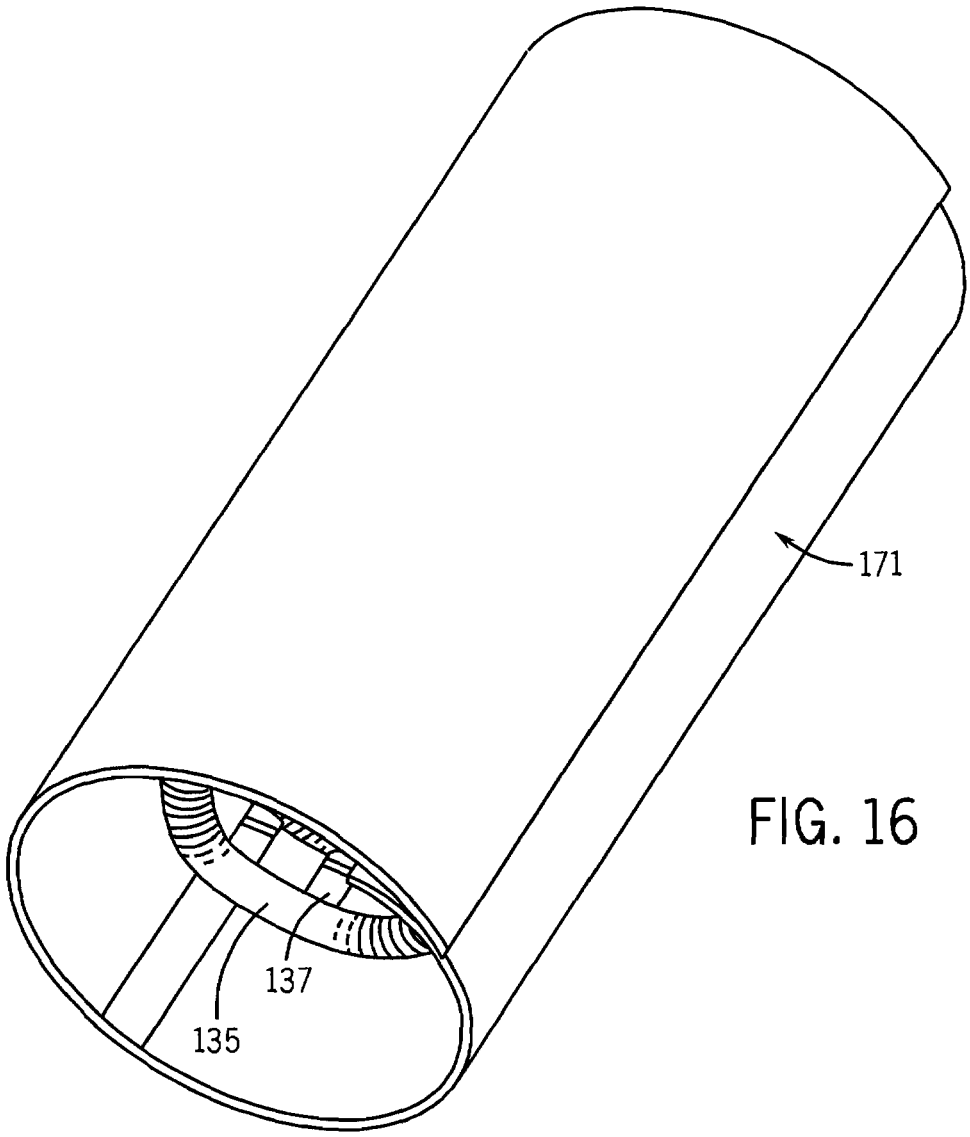
FIG. 16 shows the wrapper halves of FIGS. 2 and 4 partially wrapped around three support frame assemblies.

FIGS. 14 and 15 depict another embodiment wherein one helical wire resistance coil 173 extends along a length of conduit 171 in a helical shape and is attached to a plurality of adjacent support assemblies 133 attached to the interior of the conduit 171.

This written description uses examples to disclose the invention including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements within substantial differences from the literal languages of the claims.

Various alternatives and embodiments are contemplated as being within the scope of the following claims, particularly pointing out and distinctly claiming the subject matter regarded as the invention.

I claim:

1. An arrangement for supporting a helical wire coil heating element, the arrangement comprising:

a closed elongated tubular conduit having an open interior;

a supporting frame attached to and extending radially inwardly from the elongated tubular conduit, the supporting frame comprising a rail extending radially inwardly from the tubular conduit and having a plurality of supporting arms extending radially inwardly from the rail into the open interior in a circular pattern when viewed in the direction of elongation of the tubular conduit;

a plurality of insulating standoffs;

wherein each standoff in the plurality is a longitudinal member that is attached to a respective supporting arm such that the length of the standoff is transverse to the radially inwardly extending supporting arm;

wherein each standoff has opposing ends that receive and retain different pairs of individual convolutions of a helical wire coil heating element; and an elongated helical wire coil heating element attached to each of the opposing ends of the standoff such that the heating element wraps uniformly around opposite sides of the frame in a circular path around the open interior and is evenly spaced apart from the tubular conduit along its length.

2. An arrangement according to claim 1, wherein the rail of the supporting frame has a circular shape extending between a first end and a second end.

3. An arrangement according to claim 2, wherein the rail of the supporting frame is a flat member extending radially inwardly into the open interior.

4. An arrangement according to claim 3, wherein the first end and the second end of the rail define a gap therebetween.

5. An arrangement according to claim 4, wherein the helical wire coil heating element extends along the opposite sides of the frame and extends through the gap.

6. An arrangement according to claim 5, wherein the helical wire coil heating element bends around one of the first and second ends of the rail.

7. An arrangement according to claim 1, wherein the supporting frame comprises one of a plurality of supporting frames attached to and extending radially inwardly from the elongated tubular conduit, each support frame having a rail extending in a circular shape and a plurality of supporting arms extending radially inwardly from the rail into the open interior in a circular pattern.

8. An arrangement according to claim 7, wherein the helical wire coil heating element extends along the opposite sides of the frame and extends through the gap.

9. An arrangement according to claim 8, wherein the helical wire coil heating element extends through the gap, and along a length of the conduit, and is attached to standoffs on the plurality of supporting frames in a helical pattern.

10. An arrangement according to claim 1, wherein each supporting arm comprises a pair of tines, the pair of tines defining therebetween an open space dimensioned to receive one of the insulating standoffs inserted radially into the space.

11. An arrangement for supporting a helical wire coil heating element, the arrangement comprising:

a closed elongated tubular conduit having an open interior;

a supporting frame attached to and extending radially inwardly from the elongated tubular conduit, the supporting frame having a circular rail extending radially inwardly from the tubular conduit and having a plurality of supporting arms extending radially inwardly from the rail into the open interior in a circular pattern; and a plurality of insulating standoffs;

wherein each standoff in the plurality is a longitudinal member that is attached to a respective supporting arm such that the length of the standoff is transverse to the radially inwardly extending supporting arm;

wherein each standoff has opposing ends that receive and retain different pairs of individual convolutions of a helical wire coil heating element; and a helical wire coil heating element attached to each of the opposing ends of the standoff such that the heating element wraps uniformly around opposite sides of the frame in a circular path around the open interior and being evenly spaced from the tubular conduit;

wherein the supporting frame is connected to the elongated conduit so that it retains the conduit in a tubular shape.

12. An arrangement according to claim 11, wherein the supporting frame comprises a plurality of tabs that are engaged in a plurality of slots formed in the interior of the conduit to attach the supporting frame to the conduit and at least one of the tabs also engages a slot in the overlapped elongated ends to attached the overlapped ends together.

* * * * *